US009732539B2

(12) United States Patent
Kim

(10) Patent No.: US 9,732,539 B2
(45) Date of Patent: Aug. 15, 2017

(54) FOLDABLE FRAME FOR INSTANT TENT

(71) Applicant: Young Sub Kim, Seoul (KR)

(72) Inventor: Young Sub Kim, Seoul (KR)

( * ) Notice: Subject to any disclaimer, the term of this patent is extended or adjusted under 35 U.S.C. 154(b) by 40 days.

(21) Appl. No.: 14/939,136

(22) Filed: Nov. 12, 2015

(65) Prior Publication Data

US 2017/0138085 A1 May 18, 2017

(51) Int. Cl.

| | |
|---|---|
| ***E04H 15/46*** | (2006.01) |
| ***E04H 15/48*** | (2006.01) |
| ***E04H 15/52*** | (2006.01) |
| ***E04H 15/60*** | (2006.01) |

(52) U.S. Cl.

CPC ..... *E04H 15/46* (2013.01); *E04H 15/48* (2013.01); *E04H 15/52* (2013.01); *E04H 15/60* (2013.01)

(58) Field of Classification Search

CPC ..... E04H 15/44; E04H 15/46; E04H 15/48; E04H 15/52; E04H 15/38; E04H 15/60

USPC ..... 135/120.3; 403/164

See application file for complete search history.

(56) References Cited

U.S. PATENT DOCUMENTS 550,673 A * 12/1895 Beron ..... H02G 7/12 174/147
840,483 A * 1/1907 Earnshaw ..... E04B 1/2403 135/120.3
3,926,202 A * 12/1975 Uthemann ..... A45B 17/00 135/20.3
4,037,978 A * 7/1977 Connelly ..... F16B 7/04 403/164
4,960,144 A * 10/1990 Wheatley ..... E04H 15/60 135/117
5,884,646 A * 3/1999 Ju ..... E04H 15/42 135/124
7,766,023 B2 * 8/2010 Scherer ..... E04H 15/42 135/120.3
7,810,514 B2 * 10/2010 Lah ..... E04H 15/60 135/120.1

(Continued)

FOREIGN PATENT DOCUMENTS

KR 101561779 B1 * 10/2015

*Primary Examiner* — David R Dunn
*Assistant Examiner* — Danielle Jackson
(74) *Attorney, Agent, or Firm* — Hamre, Schumann, Mueller & Larson, P.C.

(57) ABSTRACT

Disclosed is a foldable frame which can be widely applied to instant tents which are easily installed or uninstalled and have a rectangular or square bottom surface of various sizes. With a head (100) of the foldable frame, a top plate (110) and a bottom plate (120) are engaged to each other in such a way that the center portion can be rotated in a state in which an upper ends (one end of the first rod) of the poles are respectively engaged to the rod engaging holes (111 and 111'; 121 and 121') of the top and bottom plates (110 and 120) in a diagonal direction, so that the top and bottom plates of the head are automatically rotated according to various shapes of the rectangular or square bottom surface, thereby forming an intersection angle between the pole coupling portions formed on the head (an angle of intersection between both pole coupling portions of the head). Therefore, the foldable frame can be widely applied to the instant tent, regardless of the rectangular or square shape of the bottom surface of various sizes.

3 Claims, 6 Drawing Sheets

(56) References Cited

U.S. PATENT DOCUMENTS

| | | | | |
|---|---|---|---|---|
| 8,186,369 | B2 * | 5/2012 | Reeb | E04H 15/48 135/135 |
| 8,789,550 | B2 * | 7/2014 | Livacich | E04H 15/001 135/114 |
| 9,181,724 | B2 * | 11/2015 | Kim | E04H 15/28 |
| 2005/0005961 | A1 * | 1/2005 | Chang | E04H 15/48 135/159 |
| 2006/0169729 | A1 * | 8/2006 | Reis | A45F 4/04 224/154 |
| 2009/0173369 | A1 * | 7/2009 | Lah | E04H 15/425 135/121 |
| 2015/0275541 | A1 * | 10/2015 | Lamke | E04H 15/46 135/139 |
| 2015/0330099 | A1 * | 11/2015 | Zhou | E04H 15/48 135/143 |

* cited by examiner

FOLDABLE FRAME FOR INSTANT TENT

BACKGROUND OF THE INVENTION

Field of the Invention

The present invention relates to a foldable frame for an instant tent, and more specifically, to a foldable frame which can be widely applied to instant tents which are easily installed or uninstalled and have a rectangular or square bottom surface of various sizes.

Background of the Related Art

In general, an instant tent includes a skin (referred to as a body) which is stitched to four sides of a rectangular or square bottom surface and extending to an upper portion, and foldable frames which are inserted in frame fixing loops provided on the outside of the skin.

The bottom surface of the skin is released in various shapes, such as a rectangular shape of 1400×2000 mm or a square shape of 2000×2000 mm.

The foldable frame for the instant tent according to the present invention is an integrated frame of a foldable type, in which upper ends of four foldable poles are connected to a center head, and when the tent is set up, the poles are spread in a cross shape, and in which lower ends of the four poles are respectively connected to the respective corners of the bottom surface.

However, a foldable frame head for the instant tent of the related art has coupling portions of different shapes according to the shape of the bottom surface of the tent, in which upper ends of four poles are connected to the coupling portions in a diagonal direction of the bottom surface.

Specifically, since an intersection angle between the pole coupling portions formed on a head (an angle of intersection between both pole coupling portions of the head) is varied depending upon the shape of the bottom surface, the head made of plastic through molding should be manufactured to have various shapes according to the shapes of the rectangular or square bottom surface, which causes waste of budget due to preparation of a new mold or the like.

SUMMARY OF THE INVENTION

Therefore, the present invention has been made in view of the above problems, and an object of the present invention is to provide a foldable frame which can be widely applied to instant tents which are easily installed or uninstalled and have a rectangular or square bottom surface of various sizes.

According to one aspect of the present invention, there is provided a foldable frame for an instant tent which is an integrated frame of a foldable type, in which upper ends of four foldable poles are connected to a center head, and when the tent is set up, the poles are spread in a cross shape, and in which lower ends of the four poles are respectively connected to the respective corners of the bottom surface, wherein the head includes a top plate of a circular container type having a recessed inner portion, and a bottom plate of a circular container type having a recessed inner portion; the top plate and the bottom plate are formed with rod engaging holes of a tunnel shape which are formed parallel to each other in an opposite direction, with one end being opened, while the other end being closed; each of the rod engaging holes is formed with a fixing hole, and a locking bolt is engaged to the fixing hole; the bottom plate of the head is formed with a rotation groove at a center portion thereof, and a center portion of the top plate is formed with a rotation protrusion protruding downwardly to correspond to the rotation groove, in which the rotation protrusion of the top plate is inserted into the rotation groove of the bottom plate; and a skin loop is formed with a threaded portion at an upper portion thereof, in which the upper portion of the skin loop is rotatably inserted from a lower portion of the bottom plate to an upper portion of the top plate, and a nut is engaged to the threaded portion of the skin loop in a nut groove of the top plate.

Preferably, the top plate and the bottom plate of the head are engaged to each other in such a way that the center portion can be rotated in a state in which an upper ends (one end of the first rod) of the poles are respectively engaged to the rod engaging holes of the top and bottom plates in a diagonal direction, so that the top and bottom plates of the head are automatically rotated according to various shapes of the rectangular or square bottom surface, thereby forming an intersection angle between the pole coupling portions formed on the head (an angle of intersection between both pole coupling portions of the head).

Preferably, the pole includes a first joint which has a body formed with rod coupler engaging grooves at both ends thereof, upper and lower rod couplers which are engaged to the rod coupler engaging groove to be able to rotate by an angle of 90 degrees, and engaging shafts for rotatably connecting the body and the rod couplers, in which a lower end of the first rod is inserted and fixed to the upper rod coupler of the first joint, and an upper end of the second rod is inserted and fixed to the lower rod coupler; a second joint which has an upper opening which penetrates a body of the second joint in a vertical direction, and receives the lower end of the second rod, a lower opening to which an upper end of the third rod is inserted and firmly adhered, a holding hole for the second rod which is formed at a portion of the inside, and a guider which is engaged to a portion of an upper portion of the second joint, in which the lower end of the second rod is inserted into an upper opening of the guider to be able to freely move, and the lower end of the second rod is positioned in a hollow portion, in which a cylindrical stopper having an outer diameter which is equal to an inner diameter of the third rod is engaged to the lower end of the second rod positioned in the hollow portion, thereby preventing the second rod from being released when the second rod moves in the vertical direction, and in which the guider guides the lower end of the second rod to the holding hole when the tent is set up, and guides the lower end of the second rod to the inside of the third rod when the tent is folded; and a third joint which has a telescopic structure, and is fixed to an upper end of the fourth rod, in which the third rod is freely inserted into the inside of the fourth rod, and is fixed by a snap button.

With the above configuration, the foldable frame according to the present invention can be widely applied to instant tents which are easily installed or uninstalled and have a rectangular or square bottom surface of various sizes.

DETAILED DESCRIPTION OF THE PREFERRED EMBODIMENT

Now, a foldable frame for an instant tent according to one embodiment of the present invention will be described in detail with reference the accompanying drawings.

While certain embodiments have been described, these embodiments have been presented by way of example only, and are not intended to limit the scope of the inventions. Indeed, the novel frame described herein may be embodied in a variety of other forms; furthermore, various omissions, substitutions and changes in the form of the frame described herein may be made without departing from the spirit of the inventions. The accompanying claims and their equivalents are intended to cover such forms or modifications as would fall within the scope and spirit of the inventions.

Figure 1:
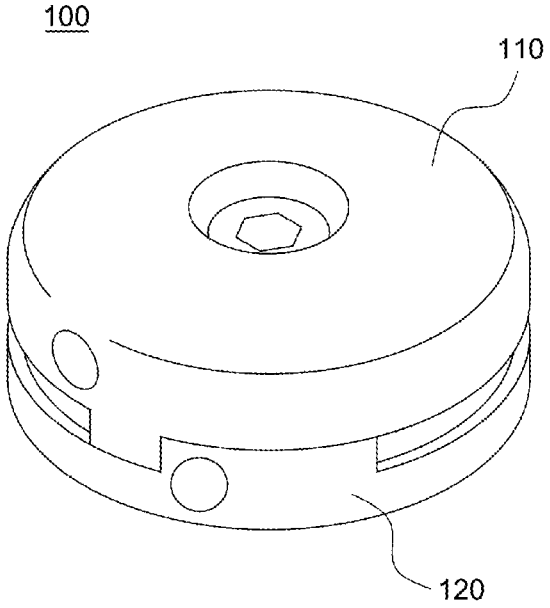
FIG. 1 is a perspective view of a head of a foldable frame for an instant tent according to one embodiment of the present invention.
Figure 2:
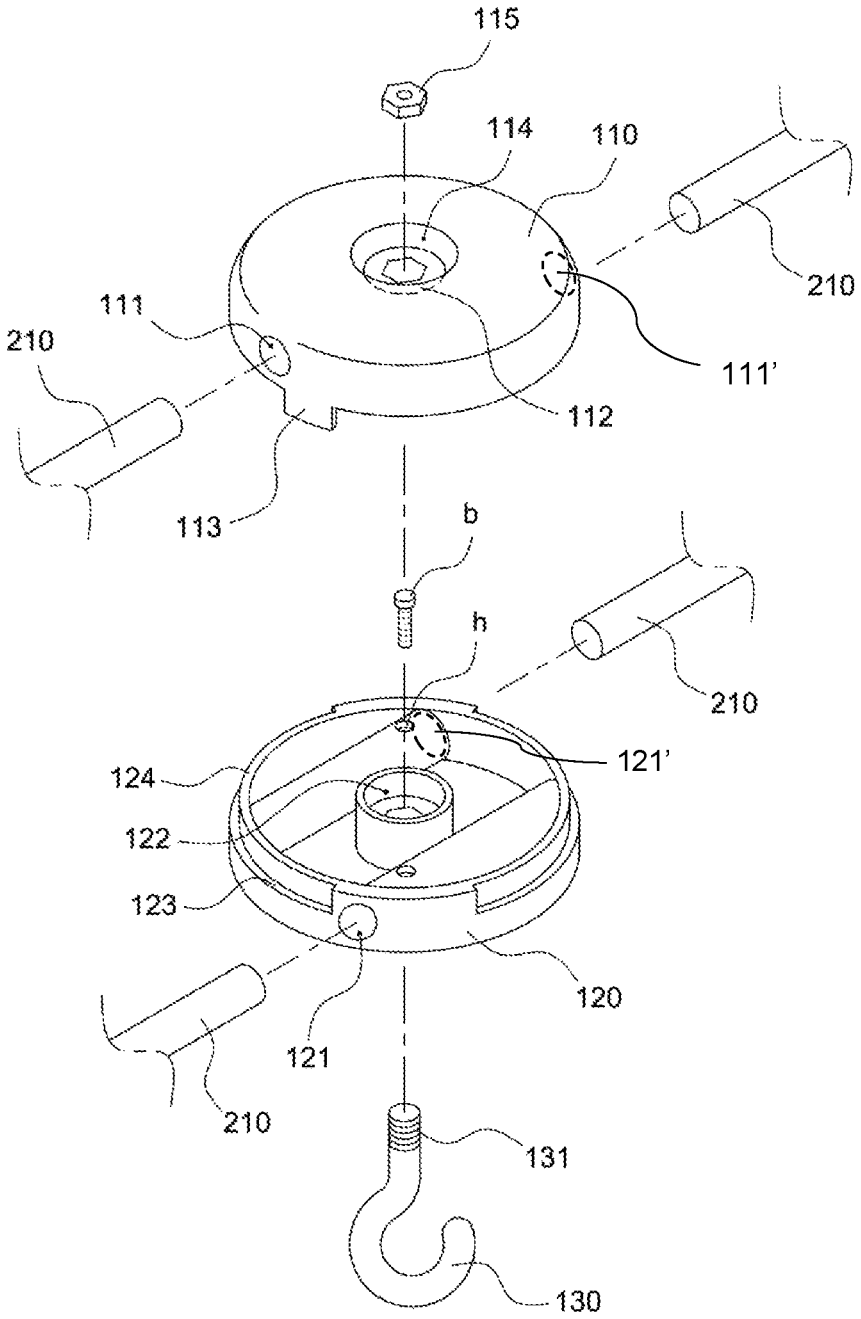
FIG. 2 is an exploded perspective view illustrating the head in FIG. 1.
Figure 3A:
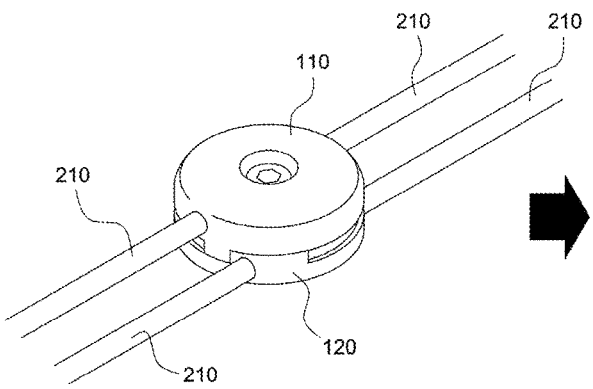
FIGS. 3A and 3B are views illustrating the operation of the head in FIG. 1.
Figure 3B:
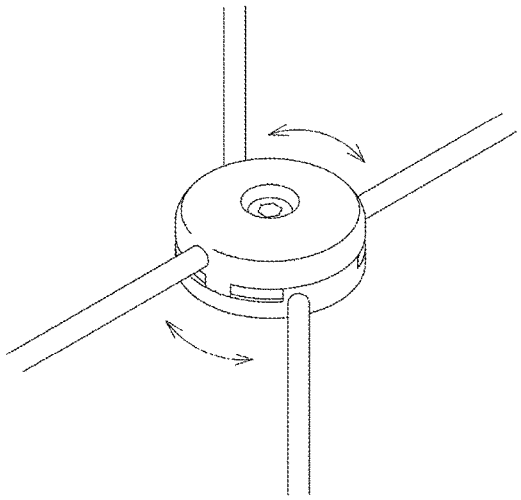
Figure 4:
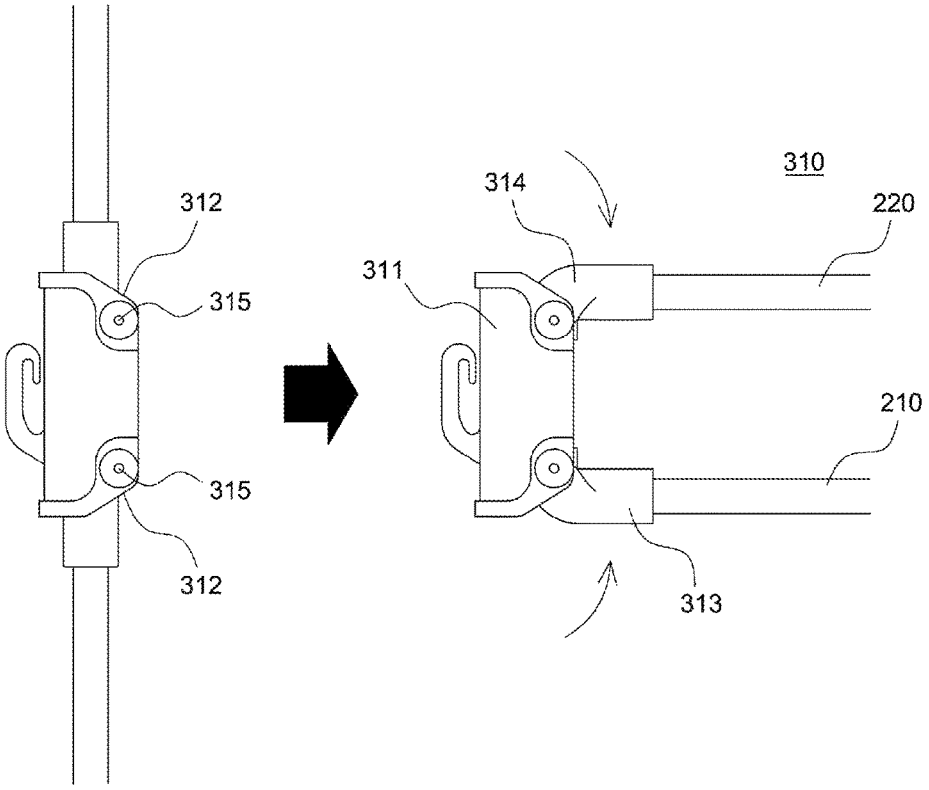
FIG. 4 is a view of a primary joint.
Figure 5:
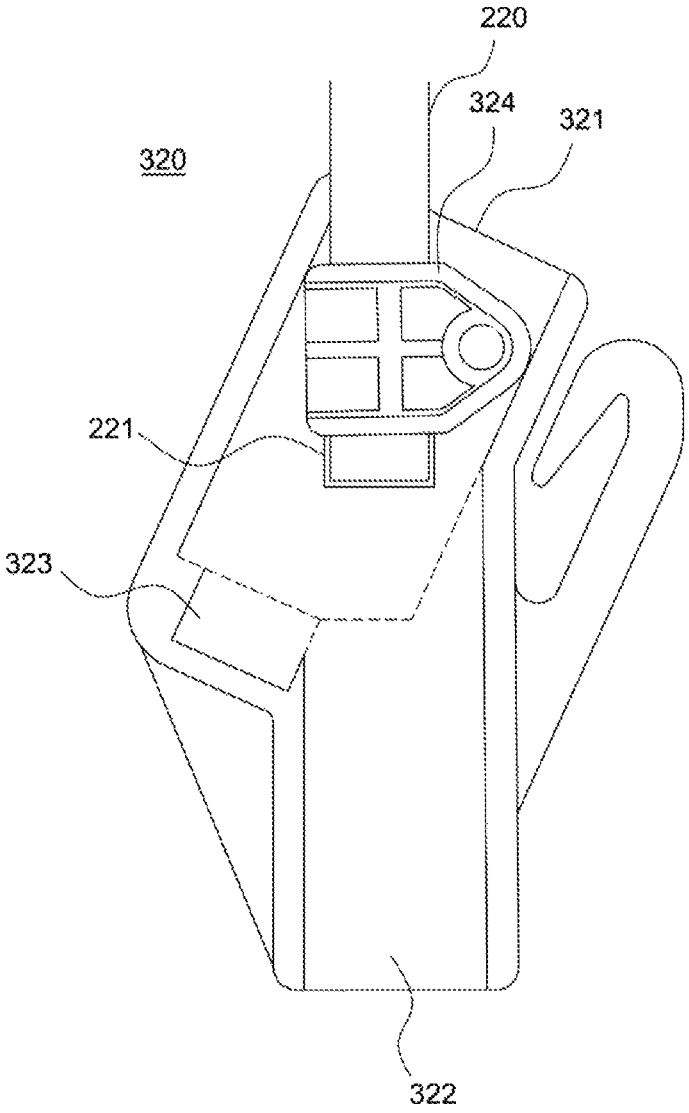
FIG. 5 is a view of a secondary joint.
Figure 6:
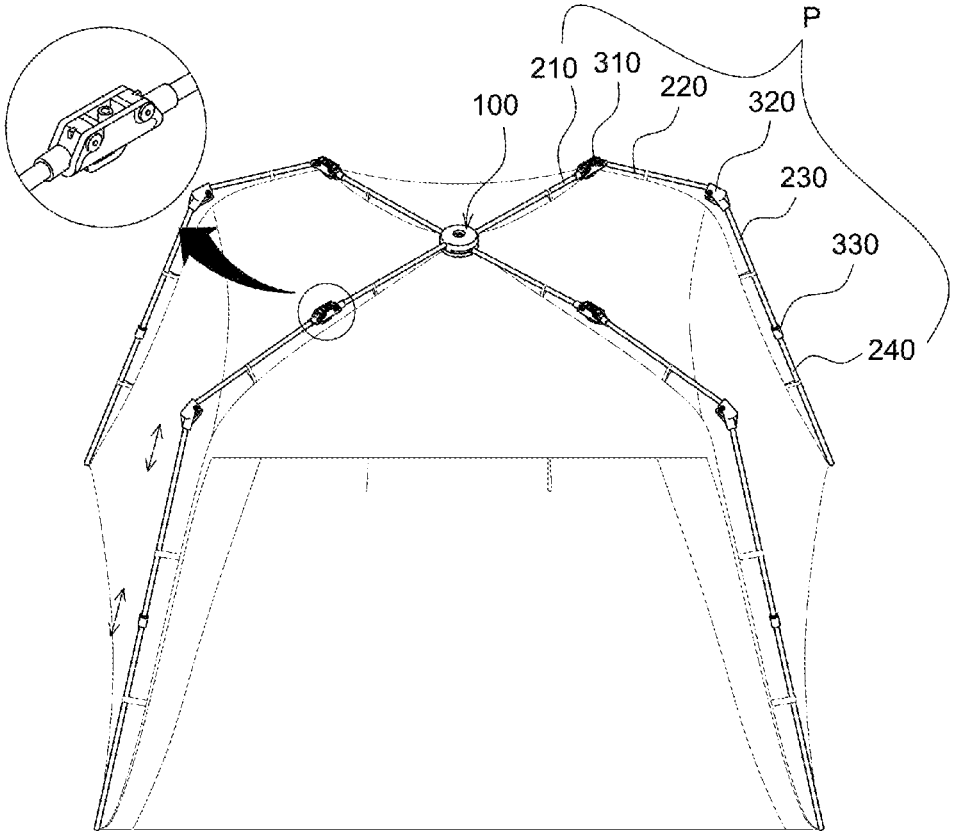
FIG. 6 is a view illustrating a set-up state of the instant tent employing the foldable frame according to the embodiment of the present invention.
Figure 7:
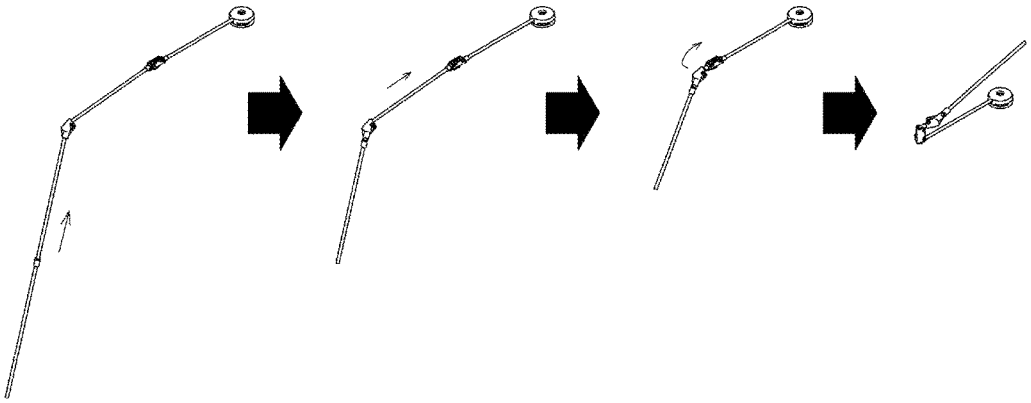
FIG. 7 is a view illustrating a process of folding one pole.

FIG. 1 is a perspective view of a head of a foldable frame for an instant tent according to one embodiment of the present invention. FIG. 2 is an exploded perspective view illustrating the head in FIG. 1. FIGS. 3A and 3B are views illustrating the operation of the head in FIG. 1. FIG. 4 is a view of a primary joint. FIG. 5 is a view of a secondary joint. FIG. 6 is a view illustrating a set-up state of the instant tent employing the foldable frame according to the embodiment of the present invention. FIG. 7 is a view illustrating a process of folding one pole.

As illustrated in FIG. 6, a foldable frame 1 for an instant tent according to the embodiment of the present invention is an integrated frame of a foldable type, in which upper ends of four foldable poles P are connected to a center head 100, and when the tent is set up, the poles P are spread in a cross shape, and in which lower ends of the four poles P are respectively connected to the respective corners of the bottom surface.

The head 100 includes, as illustrated in FIGS. 1 to 3, a top plate 110 of a circular container type having a recessed inner portion, and a bottom plate 120 of a circular container type having a recessed inner portion, and the top plate 110 and the bottom plate 120 are rotatably engaged to each other.

As illustrated in FIG. 2, the top plate 110 and the bottom plate 120 of the head 100 are formed with rod engaging holes 111 and 111'; 121 and 121' (111' and 121' shown in broken lines) of a tunnel shape which are formed parallel to each other in an opposite direction, with one end being opened, while the other end being closed. Each of the rod engaging holes 111 and 111'; 121 and 121' is formed with a fixing hole h, and a locking bolt b is engaged to the fixing hole h.

The bottom plate 120 of the head 100 is formed with a rotation groove 122 at a center portion, and a center portion of the top plate 110 is formed with a rotation protrusion 112 protruding downwardly to correspond to the rotation groove 122.

The rotation protrusion 112 of the top plate 110 is inserted into the rotation groove 122 of the bottom plate 120, and a skin loop 130 is formed with a threaded portion 131 at an upper portion thereof, in which the upper portion of the skin loop 130 is rotatably inserted from a lower portion of the bottom plate 120 to an upper portion of the top plate 110, and a nut 115 is engaged to the threaded portion 131 of the skin loop in a nut groove 114 of the top plate 110.

The bottom plate 120 is formed with an inner guide wall 124 along a circumference thereof, and the inner guide wall 124 has a stepped portion 123 formed on an outer surface, except for a circumference of the rod engaging holes 121 and 121' of the bottom plate 120, and having a half thickness.

The top plate 110 is formed integrally with stoppers 113 of a desired length at an outer circumference of a half thickness.

When the top plate 110 is engaged to the bottom plate 120, the stopper 113 is guided by the guide wall 124, and is smoothly rotated on the circumference of the bottom plate 120 along the stepped portion 123 of the bottom plate 120.

The foldable frame of the present invention has four poles P, and each pole P has four segment rods 200 and three joints 300 for connecting the rods to form the pole P.

Hereinafter, the four rods constituting the pole P have a first rod 210, a second rod 220, a third rod 230, and a fourth rod 240 in order from a top, and the three joints for connecting the rods have a first joint 310, a second joint 320, and a third joint 330.

Since the configuration of the four poles is equal to each other, one pole P will now be described in detail for convenience.

One end of the first rod 210 is engaged to any one of the rod engaging holes 111 and 111'; 121 and 121' of the head 100, and the other end is engaged to an upper rod engaging hole of an upper rod coupler 313 of the first joint 310.

The first joint 310 has, as illustrated in FIG. 4, a body 311 formed with rod coupler engaging grooves 312 at both ends thereof, upper and lower rod couplers 313 and 314 which are engaged to the rod coupler engaging groove 312 to be able to rotate by an angle of 90 degrees, and engaging shafts 315 for rotatably connecting the body and the rod couplers.

Preferably, a bottom surface of the body 311 may be formed with a locking member.

A lower end of the first rod 210 is inserted and fixed to the upper rod coupler 313 of the first joint 310, and an upper end of the second rod 220 is inserted and fixed to the lower rod coupler 314.

The second joint 320 is disclosed by Korea Patent No. 10-1561779 (registered on Oct. 13, 2015), entitled (Instant Tent Pole) and assigned to the applicant. The second joint 320 of the present invention has an upper opening 321 which penetrates a body of the second joint in a vertical direction, and receives the lower end of the second rod 220, a lower opening 322 to which an upper end of the third rod 230 is inserted and firmly adhered, a holding hole 323 for the second rod 220 which is formed at a portion of the inside, and a guider 324 which is engaged to a portion of an upper portion of the second joint.

The lower end of the second rod 220 is inserted into an upper opening of the guider 324 to be able to freely move, and the lower end of the second rod 220 is positioned in a hollow portion. A cylindrical stopper 221 having an outer diameter which is equal to an inner diameter of the third rod 230 is engaged to the lower end of the second rod 220 positioned in the hollow portion, thereby preventing the second rod 220 from being released when the second rod 220 moves in the vertical direction.

The guider 324 guides the lower end of the second rod 220 to the holding hole 323 when the tent is set up, and guides the lower end of the second rod 220 to the inside of the third rod 230 when the tent is folded.

The third joint 330 has a telescopic structure, and is fixed to an upper end of the fourth rod 240. The third rod 230 is freely inserted into the inside of the fourth rod 240, as illustrated in FIG. 4, and fixed by a snap button.

Specifically, one pole P has the first joint 310 which has the body 311 formed with the rod coupler engaging grooves 312 at both ends thereof, the upper and lower rod couplers 313 and 314 which are engaged to the rod coupler engaging groove 312 to be able to rotate by the angle of 90 degrees, and the engaging shafts 315 for rotatably connecting the body and the rod couplers; the first joint 310 in which the lower end of the first rod 210 is inserted and fixed to the upper rod coupler 313 of the first joint 310, and the upper end of the second rod 220 is inserted and fixed to the lower rod coupler 314; the second joint 320 which has the upper opening 321 which penetrates the body of the second joint 320 in the vertical direction, and receives the lower end of the second rod 220, the lower opening 322 to which the upper end of the third rod 230 is inserted and firmly adhered, the holding hole 323 for the second rod 220 which is formed at the inside thereof, and the guider 324 which is engaged to the upper portion of the second joint 320, in which the lower end of the second rod 220 is inserted into the upper opening of the guider 324 to be able to freely move, and the lower end of the second rod 220 is positioned in the hollow portion, in which the cylindrical stopper 221 having the outer diameter which is equal to the inner diameter of the third rod 230 is engaged to the lower end of the second rod 220 positioned in the hollow portion, thereby preventing the second rod 220 from being released when the second rod 220 moves in the vertical direction, and in which the guider 324 guides the lower end of the second rod 220 to the holding hole 323 when the tent is set up, and guides the lower end of the second rod 220 to the inside of the third rod 230 when the tent is folded; and the third joint 330 which has a telescopic structure, and is fixed to an upper end of the fourth rod 240, in which the third rod 230 is freely inserted into the inside of the fourth rod 240, and is fixed by the snap button.

The operation of the foldable frame for the instant tent according to the embodiment of the present invention will now be described in detail.

As illustrated in FIG. 6, the foldable frame 1 for the instant tent according to the embodiment of the present invention is the integrated frame of the foldable type, in which the upper ends of four foldable poles P are connected to the center head 100, and when the tent is set up, the poles P are spread in the cross shape, and in which the lower ends of the four poles P are respectively connected to the respective corners of the bottom surface.

First, the instant tent is positioned at the center region of a desired set-up area of the tent.

The lower portions of the four poles P which are folded to the first joint 310 are sequentially unfolded.

As will be understood from FIG. 6, the third rods 230 are telescopically withdrawn from the fourth rods 240 one by one of the four poles P while lifting the head 100 by a hand, and then the snap buttons are locked. The second rods 220 are withdrawn from the third rod 230, and then the lower end of the second rod 220 is held in the holding hole 323 of the second rod 220 in the second joint 320, thereby easily completing installation of the instant tent.

In this instance, the top plate 110 and the bottom plate 120 of the head 100 are engaged to each other in such a way that the center portion can be rotated in the state in which the upper end (one end of the first rod) of the poles are engaged to the head in the diagonal direction of the bottom surface. If the foldable frame 1 according to the present invention is unfolded in the cross shape according to the various shapes of the rectangular or square bottom surface, the top plate 110 and the bottom plate 120 of the head 100 are automatically rotated, as illustrated in FIG. 3, thereby forming an intersection angle between the pole coupling portions formed on the head (an angle of intersection between both pole coupling portions of the head). Therefore, the foldable frame of the present invention can be widely applied to the instant tents, regardless of various rectangular or square shapes of the bottom surface.

On the contrary, in the case of taking down the instant tent, the process is carried out in order opposite to the above process.

Specifically, as illustrated in FIG. 7, the snap buttons of the third joints are unlocked one by one of the four poles P, and then the third rods 230 are telescopically inserted in the fourth rods 240. The second rods 220 are withdrawn from the holding holes 323 of the second joints 320, and then are inserted into the third rods 230.

Next, the four poles P with the rods (second and third rods) being received are folded around the first joints 310, respectively, and are aligned parallel to each other in the shape of 11 letters, and the skin are rolled and put in a case, thereby easily completing the clearance.

In this instance, it would be understood from FIG. 3 that since the top plate 110 and the bottom plate 120 of the head 100 are engaged to each other in such a way that the center portion can be rotated in the state in which the upper ends (one end of the first rod) of the poles are engaged to the head in the diagonal direction of the bottom surface, the four poles P received the rods therein can be easily arranged parallel to each other.

While the foldable frame 1 for the instant tent according to the present invention has been described with reference to the particular illustrative embodiments, it is not to be restricted by the embodiments but only by the appended claims. It is to be appreciated that those skilled in the art can change or modify the embodiments without departing from the scope and spirit of the present invention. Of course, equivalents thereof are contained in the present invention.

What is claimed is:

1. A foldable frame for an instant tent which is an integrated frame of a foldable type, in which upper ends of four foldable poles are connected to a center head, and when the tent is set up, the poles are spread in a cross shape, and in which lower ends of the four poles are respectively connected to respective corners of a bottom surface, wherein the head includes a top plate of a circular container type having a recessed inner portion, and a bottom plate of a circular container type having a recessed inner portion;

the top plate and the bottom plate are formed with rod engaging holes of a tunnel shape which are formed parallel to each other in an opposite direction, with one end being opened, while the other end being closed;

each of the rod engaging holes is formed with a fixing hole, and a locking bolt is engaged to the fixing hole;

the bottom plate of the head is formed with a rotation groove at a center portion thereof, and a center portion of the top plate is formed with a rotation protrusion protruding downwardly to correspond to the rotation groove, in which the rotation protrusion of the top plate is inserted into the rotation groove of the bottom plate; and a skin loop is formed with a threaded portion at an upper portion thereof, in which the upper portion of the skin loop is rotatably inserted from a lower portion of the bottom plate to an upper portion of the top plate, and a nut is engaged to the threaded portion of the skin loop in a nut groove of the top plate.

2. The foldable frame for the instant tent according to claim 1, wherein the top plate and the bottom plate of the head are engaged to each other in such a way that the center portion can be rotated in a state in which upper ends of the poles are respectively engaged to the rod engaging holes of the top and bottom plates in a diagonal direction, so that the top and bottom plates of the head are automatically rotated according to various shapes of the bottom surface, thereby forming an intersection angle between pole coupling portions formed on the head.

3. The foldable frame for the instant tent according to claim 1, wherein each of the four foldable poles includes:

a first rod;

a second rod;

a third rod;

a fourth rod;

a first joint which has a body formed with rod coupler engaging grooves at both ends thereof, upper and lower rod couplers which are engaged to the rod coupler engaging grooves to be able to rotate by an angle of 90 degrees, and engaging shafts for rotatably connecting the body and the rod couplers, in which a lower end of the first rod is inserted and fixed to the upper rod coupler of the first joint, and an upper end of the second rod is inserted and fixed to the lower rod coupler;

a second joint which has an upper opening which penetrates a body of the second joint in a vertical direction, and receives the lower end of the second rod, a lower opening to which an upper end of the third rod is inserted and firmly adhered, a holding hole for the second rod disposed inside the second joint, and a guider which is engaged to an upper portion of the second joint, in which the lower end of the second rod is inserted into an upper opening of the guider to be able to freely move, and the lower end of the second rod is positioned in a hollow portion, in which a cylindrical stopper having an outer diameter which is equal to an inner diameter of the third rod is engaged to the lower end of the second rod positioned in the hollow portion, thereby preventing the second rod from being released when the second rod moves in the vertical direction, and in which the guider guides the lower end of the second rod to the holding hole when the tent is set up, and guides the lower end of the second rod to the inside of the third rod when the tent is folded; and a third joint which has a telescopic structure, and is fixed to an upper end of the fourth rod, in which the third rod is freely inserted into the inside of the fourth rod, and is fixed by a snap button.

* * * * *